US008803428B2

(12) United States Patent
Tseng et al.

(10) Patent No.: US 8,803,428 B2
(45) Date of Patent: Aug. 12, 2014

(54) CURRENT-LIMITING DEVICE AND LIGHT-EMITTING DIODE APPARATUS CONTAINING THE SAME

(75) Inventors: Chun Teng Tseng, Sanwan Township, Miaoli County (TW); David Shau Chew Wang, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 168 days.

(21) Appl. No.: 13/427,192

(22) Filed: Mar. 22, 2012

(65) Prior Publication Data

US 2013/0249415 A1 Sep. 26, 2013

(51) Int. Cl.
*H05B 37/02* (2006.01)

(52) U.S. Cl.
USPC ..... 315/185 R; 315/291; 315/294; 315/308; 315/309; 315/312

(58) Field of Classification Search
USPC ..... 315/185 R, 291, 294, 308, 309, 312
See application file for complete search history.

(56) References Cited

U.S. PATENT DOCUMENTS

| | | | | |
|---|---|---|---|---|
| 5,644,461 | A * | 7/1997 | Miller et al. | 361/56 |
| 2008/0111505 | A1* | 5/2008 | Wang et al. | 315/309 |
| 2011/0068696 | A1* | 3/2011 | van de Ven et al. | 315/152 |
| 2013/0140590 | A1* | 6/2013 | Hsieh et al. | 257/89 |

FOREIGN PATENT DOCUMENTS

| | | | |
|---|---|---|---|
| TW | 201103362 | A | 1/2011 |
| TW | 201143511 | A | 12/2011 |

* cited by examiner

*Primary Examiner* — Douglas W Owens
*Assistant Examiner* — Thai Pham
(74) *Attorney, Agent, or Firm* — Egbert Law Offices, PLLC

(57) ABSTRACT

An LED apparatus includes an LED component and a current-limiting device. The LED component includes at least one LED having a corresponding current-limiting resistance value. The current-limiting device includes a plurality of PTC devices connected in series. The plurality of PTC devices are capable of effectively sensing the temperature of the LED and are electrically coupled to the LED component. The resistance value of the current-limiting device increases with the increment of sensed temperature. The current-limiting device has a resistance close to or equal to the current-limiting resistance value at a temperature at which the LED operates normally. When the temperature of the LED gradually increases to an abnormal temperature, current allowable to be flowed through the current-limiting device gradually decreases to be lower than LED operating current.

16 Claims, 4 Drawing Sheets

CURRENT-LIMITING DEVICE AND LIGHT-EMITTING DIODE APPARATUS CONTAINING THE SAME

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to a current-limiting device and a light-emitting diode (LED) apparatus containing the same. The current-limiting device includes a plurality of positive temperature coefficient (PTC) devices and is connected to LED in series for real-time current regulation.

2. Description of Related Art Including Information Disclosed Under 37 CFR 1.97 and 37 CFR 1.98

Like a diode, current flows through an LED with forward bias and will be cut off with a reverse bias. However, the LED current flowing therethrough emits light, and an operating voltage for forward conduction is usually higher than that of a diode such as 0.7 volts. The operating voltage does not change as current varies. Thus the LED cannot directly connect to a power source with a voltage higher than the forward voltage and a current-limiting resistor is utilized to prevent the LED from burn-out caused by high current. In a case that a battery of 9V is directly connected to two ends of the LED and the LED has a forward voltage of 2.3V, the LED attempts to sustain a voltage of 2.3V at its two ends. However, the battery attempts to drive the voltage to 9V. Therefore, a voltage difference between 9V and 2.3V will cause a very large current to burn the LED out if there is only a very small resistance.

A simple resolution is to associate with a current-limiting resistor. FIG. 1A shows an LED circuitry 10, in which a current-limiting resistor 11 is connected to an LED 12 in series and coupled to a power supply voltage $V_{cc}$. The resistance R of the current-limiting resistor 11 can be obtained according to the equation: $R=(V_{cc}-V_f)/I_f$, where $V_{cc}$ is power supply voltage, $V_f$ is LED forward voltage, and $I_f$ is LED operating current.

FIG. 1B exemplifies an LED I-V curve, in which $V_{cc}$=6V, $V_f$=3.8V and $I_f$=50 mA. The resistance of the current-limiting resistor 11 is 44Ω ((6V−3.8V)/0.05 A=44Ω). The current-limiting resistor is traditionally a fixed resistor, so that when $V_{cc}$ increases to above 9V, $V_f$ becomes greater than 4.2V. This event will induce that LED 12 heats up and be damaged.

The current-limiting resistor can provide LED protection as mentioned. However, because of high heat generation, a high power LED for illumination cannot instantly regulate its current when LED temperature rises. As a result, LED temperature will continuously increase or maintain at a high temperature, this event may burn the LED out or decrease the lifetime of the LED.

BRIEF SUMMARY OF THE INVENTION

To overcome the shortcomings of the traditional designs, a current-limiting device of the present application includes a plurality of PTC devices so as to magnify the resistance compared to the use of a single PTC device. The current-limiting device of the present application can perform LED current regulation to control LED temperature before the PTC devices reach trip temperature, thereby avoiding or diminishing the impact of LED at high temperature.

According to an embodiment of the present application, an LED apparatus is coupled to a power supply voltage and includes a LED component and a current-limiting device. The LED component corresponds to a current-limiting resistance value and includes one or more LEDs. The LED has an LED forward voltage and an LED operating current. The current-limiting device includes a plurality of PTC devices connected in series. The PTC devices are capable of effectively sensing LED temperatures and are electrically coupled to the LED component in series.

The LED apparatus may use a plurality of LEDs in the form of a strip or an array to meet the demand of illumination. In an embodiment, the LED component includes n LEDs connected in series, where n is a positive integer greater than or equal to two. The current-limiting resistance value is equal to (power supply voltage−n×LED forward voltage)/LED operating current.

The resistance value of the current-limiting device increases with increasing sensed temperature. The resistance value of the current-limiting device at an LED normal operating temperature is close to or equal to the current-limiting resistance value. When the temperature of the LED gradually increases to an abnormal temperature, current allowable to be flowed through the current-limiting device gradually decreases to lower than the LED operating current.

The plurality of PTC devices connected in series serve as the current-limiting device to magnify the resistance. The PTC devices can decrease LED current before reaching the trip temperature, so as to avoid the occurrence of high-temperature LED and LED damage and increase LED lifetime.

BRIEF DESCRIPTION OF THE SEVERAL VIEWS OF THE DRAWINGS

The present application will be described according to the appended drawings in which.

DETAILED DESCRIPTION OF THE INVENTION

Because the resistance of conductive composite materials exhibiting PTC behavior is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance instantaneously increases to a high resistance state (e.g., at least $10^2\Omega$), so as to suppress over-current and protect the cell or the circuit device. The temperature at which the resistance significantly increases is the so-called trip temperature. Before the trip temperature, the resistance of PTC device increases as temperature rises. This feature before PTC device trips is hereby utilized for designing a current-limiting device capable of instantly regulating LED currents.

Figure 1A:
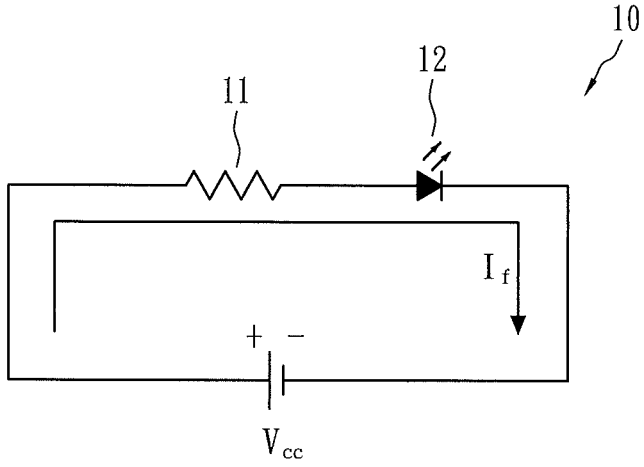
FIG. 1A (Prior Art)
FIG. 1A and FIG. 1B show a known LED apparatus.
Figure 1B:
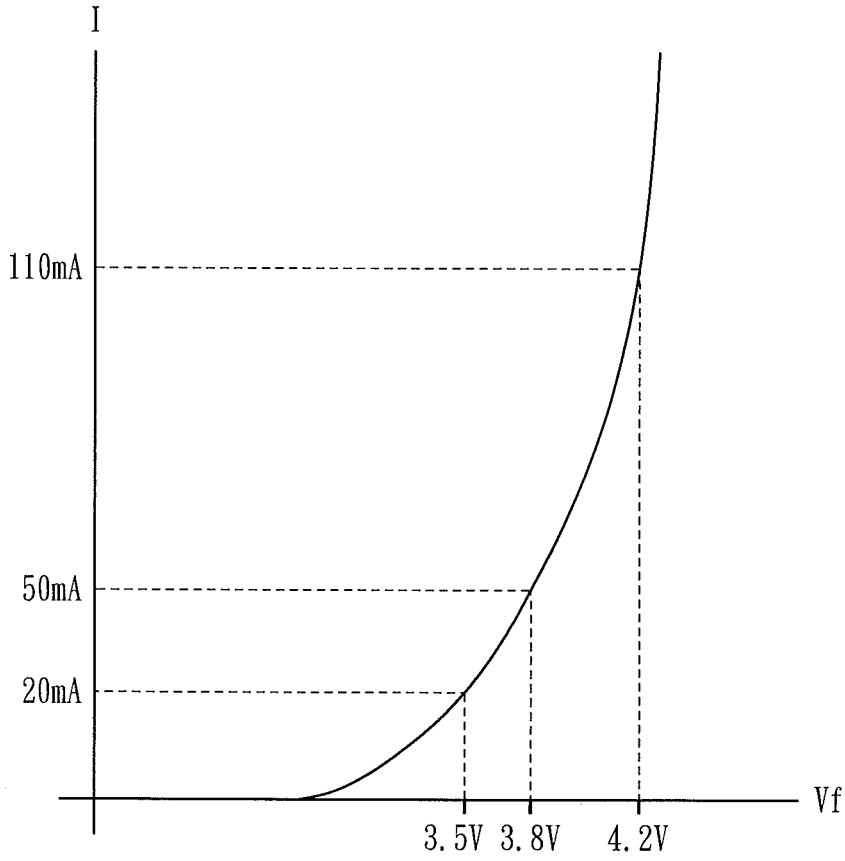
FIG. 1B (Prior Art)
Figure 2:
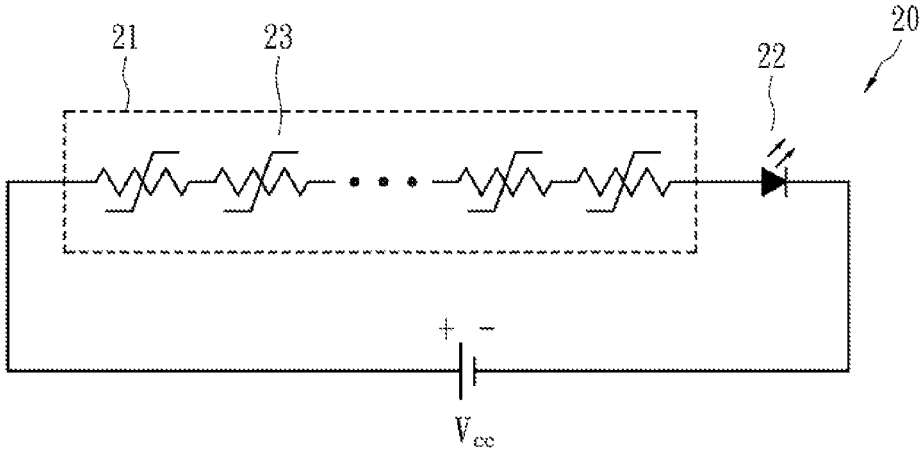
FIG. 2 shows an LED apparatus in accordance with a first embodiment of the present application.

FIG. 2 shows an LED apparatus 20 in accordance with a first embodiment of the present application. The LED apparatus 20 includes an LED 22 and a current-limiting device 21. The LED 22 and the current-limiting device 21 are connected in series, and are coupled to a power supply voltage $V_{cc}$. The LED 22 corresponds to a current-limiting resistance value:

$$\text{Current-limiting resistance} = \frac{\text{Power supply voltage } V_{cc} - \textit{LED} \text{ forward voltage } V_f}{\textit{LED} \text{ operating current } I_f}$$

The current-limiting device 21 includes a plurality of PTC devices 23 connected in series. The PTC devices 23 are placed in the vicinity of the LED 22, i.e., an effective temperature sensing area, to sense the temperature of the LED 22. The distance between the current-limiting device 21 and the LED 22 is usually smaller than 10 centimeters, or less than 5 or 3 centimeters in particular.

In an embodiment, if $V_{cc}$=6V, $V_f$=3.8V and $I_f$=50 mA, then the current-limiting resistance is: (6V 3.8V)/0.05 A=44Ω.

In an embodiment, the current-limiting device 21 includes 22 PTC devices 23 connected in series. A single PTC device 23 at room temperature 25° C. has a resistance of 2Ω, so the resistance value of the current-limiting device 21 is 44Ω. The current allowable to go through the current-limiting device 21 is (6V−3.8V)/22×2Ω=0.05 A=50 mA. If the temperature of LED 22 continuously increases to 100° C. and each PTC device 23 has a higher resistance of 6Ω at 100° C., then the current decreases to (6V−3.8V)/22×6Ω=0.016 A=16 mA. It should be appreciated that the PTC devices 23 have yet to increase to trip temperature, for example, 110° C., but current limitation is in effect to thereby diminish heat generated by the LED 22.

According to the current-limiting device of the present application, the resistance value thereof is not constant and is changed as temperature rises. To avoid low operating current of the LED 22 that may be caused by resistance inaccuracy, less PTC devices 23 are used, by which the resistance value of the current-limiting device 21 is close to but a little bit smaller than the resistance calculated by the above equation. That is:

$$\text{Current-limiting resistance} \leqq \frac{\text{Power supply voltage } V_{cc} - \textit{LED} \text{ forward voltage } V_f}{\textit{LED} \text{ operating current } I_f}$$

In an embodiment, the current-limiting device 21 may use 20 PTC devices 23 each has a resistance of 2Ω at room temperature 25° C., and the 20 PTC devices are connected in series. Therefore, the resistance of the current-limiting device 21 is 40Ω and allowable current flowing through the current-limiting device 21 is (6V−3.8V)/40Ω=0.055 A=55 mA that is a little bit higher than operating current of the LED 22. If the resistance of the current-limiting device 21 increases to 120Ω at 100° C., then the allowable current flowing through the current-limiting device 21 is (6V−3.8V)/120Ω=0.018 A=18 mA. It should be noted that the PTC devices 23 have yet to reach the trip temperature, for example, 110° C.; however current-limitation takes place effectively.

In practice, the current-limiting device 21 at a normal LED operating temperature such as room temperature has a resistance value close to or equal to the current-limiting resistance value. In an embodiment, the difference is less than 30%, i.e., the current-limiting device 21 at the LED normal operating temperature has a resistance different from the current-limiting resistance value by less than 30% variance. That is, $$\frac{|\text{Resistance value of current-limiting device} - \text{Current-limiting resistance}|}{\text{Current-limiting resistance}}$$

is less than 30%, and may be less than 20%, 15% or 10%, in particular.

The aforesaid embodiments in which the temperature increases to 100° C. is an extreme hypothesis for explanation. In practical operation the resistance value of the current-limiting device 21 increases with increasing temperature, thereby decreasing the current going through the LED 22 and diminishing incremental rate of the temperature of the LED 22. The higher the temperature of the LED 22, the lower the current flowing therethrough is. Therefore, current is instantaneously regulated and ideally thermal equilibrium is reached eventually. In usual, LED temperatures (such as LED substrate temperature which is easily measured) larger than or equal to 60° C., 70° C., 80° C., 90° C. or 100° C. would be viewed abnormal temperatures. The trip temperature of PTC devices may be 70° C., 80° C., 90° C., 100° C. or 110° C. In an embodiment, the trip temperature is greater than the abnormal temperature by 10° C.-35° C. In an environment of high ambient temperature or poor heat dissipation, the LED abnormal temperature would be lower. It should be noted that the PTC devices have not reached the trip temperature yet as the LED 22 increases to an abnormal temperature.

The selection of the PTC device 23 may consider the following criteria. At normal operation temperatures of the LED 22, the PTC devices 23 does not trip and the current allowable to be flowed therethrough has to be close to operating current of the LED 22. Assuming the operating current of the LED 22 is 50 mA, and LED 22 operates normally at 50° C. If a PTC device "A" at room temperature, i.e., 25° C., allows a current of 50 mA flowing therethrough, and such current decreases to 30 mA at 50° C., which is much lower than the operating current of LED 22; thus the PTC device "A" is not suitable for this application. If a PTC device "B" at room temperature, i.e., 25° C., allows a current of 70 mA flowing therethrough, and such current decreases to 50 mA at 50° C., which is close to or equal to the operating current of LED 22; therefore the PTC device "B" can be used. Moreover, the number of the PTC devices "B" can be determined in light of the LED current-limiting resistance value.

In other words, the current-limiting device 21 increases its resistance value with increasing temperatures, and the current-limiting device 21 at an LED normal operating temperature such as room temperature has a resistance value close to or equal to the current-limiting resistance value. When LED 22 gradually heats up to an abnormal temperature greater than the LED normal operating temperature, the current allowable to be flowed through the current-limiting device 21 gradually decreases to be lower than the LED operating current. Accordingly, in addition to basic current-limiting function, the current-limiting device 21 is able to instantly regulate current according to LED temperature.

Traditionally the resistance of the PTC device for current limitation applied to LED is extremely low. Thus, PTC device does not effectively perform current-limitation until the PTC device significantly increases its resistance as reaching the trip temperature. This current change is like thermal cut-off for battery applications. Because the resistance of the PTC device changes tremendously at the trip temperature, LED brightness will drop significantly. This is not allowed for many illumination applications such as vehicles for safety concerns.

Figure 5:
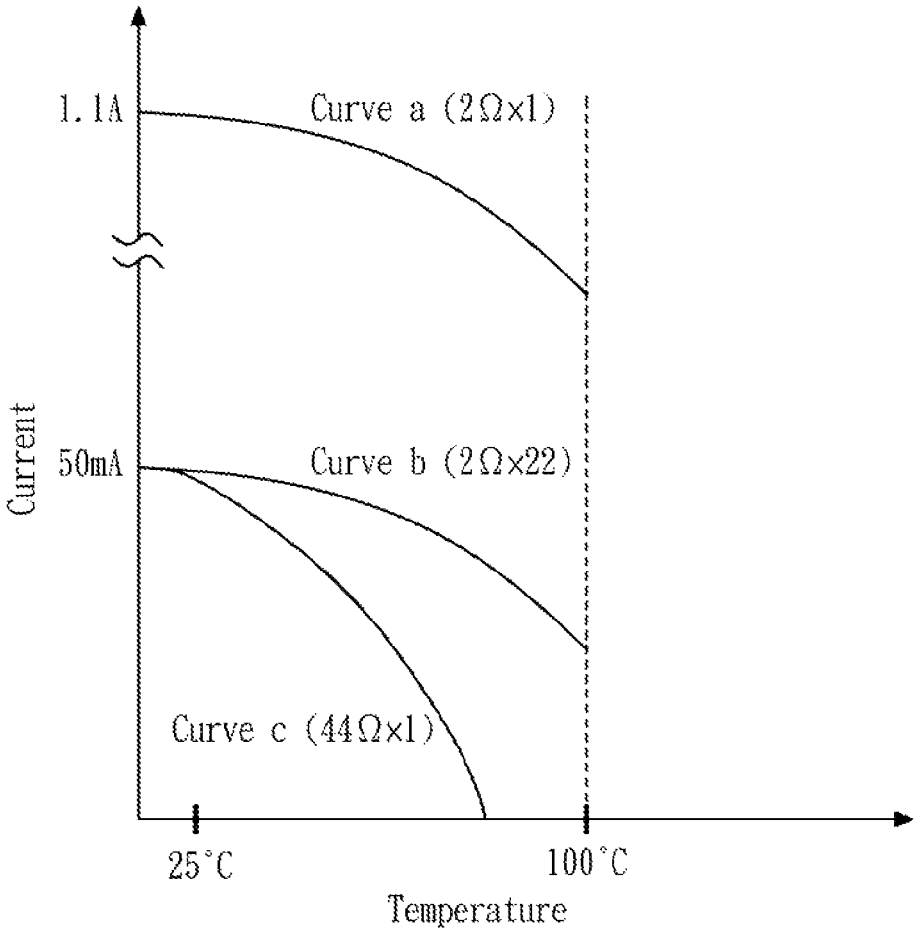
FIG. 5 shows current vs. temperature relationship of PTC device(s) of an LED apparatus.

FIG. 5 shows current vs. temperature relationship. If a single PTC device 23 has a resistance value of 2Ω at 25° C., the current allowable to be flowed therethrough is (6V−3.8V)/2Ω=1.1 A. In a case that PTC device 23 has a resistance value of 6Ω at an abnormal temperature 100° C., the allowable current flowing therethrough drops to (6V−3.8V)/6Ω=0.37 A=370 mA, as illustrated by Curve "a". Because the PTC device 23 allows a current flowing therethrough higher than the LED operating current of 50 mA, the LED continuously heats up and the current does not significantly decrease until reaching trip temperature. Therefore, it cannot perform real-time current regulation. If 22 PTC devices 23 each has a resistance of 2Ω are used, then the 22 PTC devices 23 connected in series have a resistance of 44Ω, the current allowable to be flowed therethrough is (6V−3.8V)/44Ω=0.05 A=50 mA, which is approximately equal to the operating current of the LED 22. In a case that the PTC devices 23 have a higher resistance of 132Ω at 100° C., the allowable current becomes (6V−3.8V)/132Ω=0.017 A=17 mA, as illustrated by Curve "b". The current decreasing rate with increasing temperature of Curves "a" and "b" are similar. In this embodiment, although the PTC devices 23 have yet to reach trip temperature (e.g., 110° C.), effective current-limitation takes place. Furthermore, if a single PTC device of 44Ω is used, the single PTC device of a high resistance indicates that its material has less conductive paths compared to that of a single PTC device of 2Ω. When same current is applied, the one of 2Ω allows the majority of current to flow therethrough and slowly increases its resistance. From a microcosmic aspect, because the one of 44Ω cannot allow the majority of current to flow therethrough, the PTC device will heat up rapidly and trip thereafter to block the current flow, as illustrated by Curve "c". In other words, because of the higher resistance of the PTC device of 44Ω, the heat generated by the device increases significantly compared to the one of 2Ω when undertaking same current. Therefore, the PTC device of 44Ω heats up much faster than those of 2Ω and 2Ω×22, and will reach the trip temperature earlier and cause significant change of LED brightness.

Figure 3:
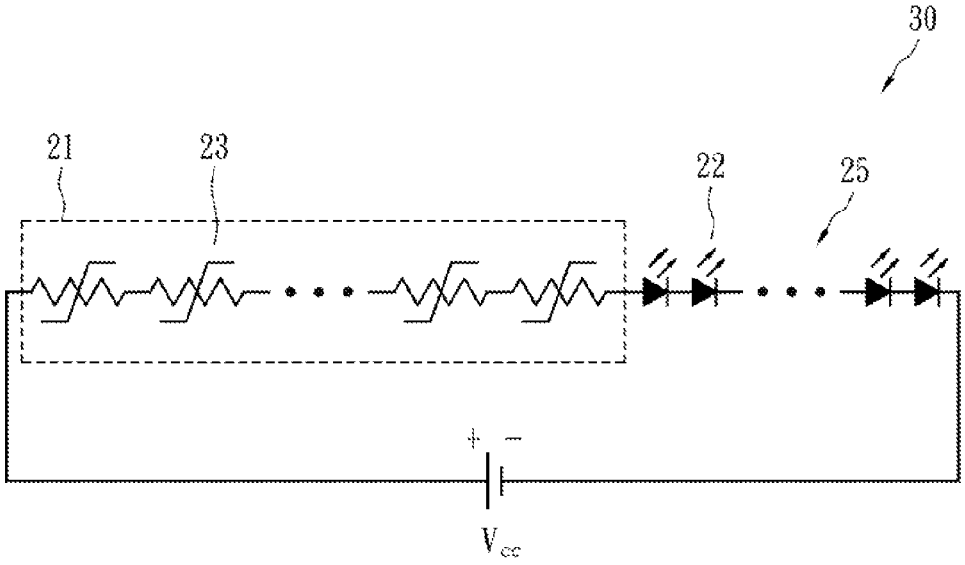
FIG. 3 shows an LED apparatus in accordance with a second embodiment of the present application.
Figure 4:
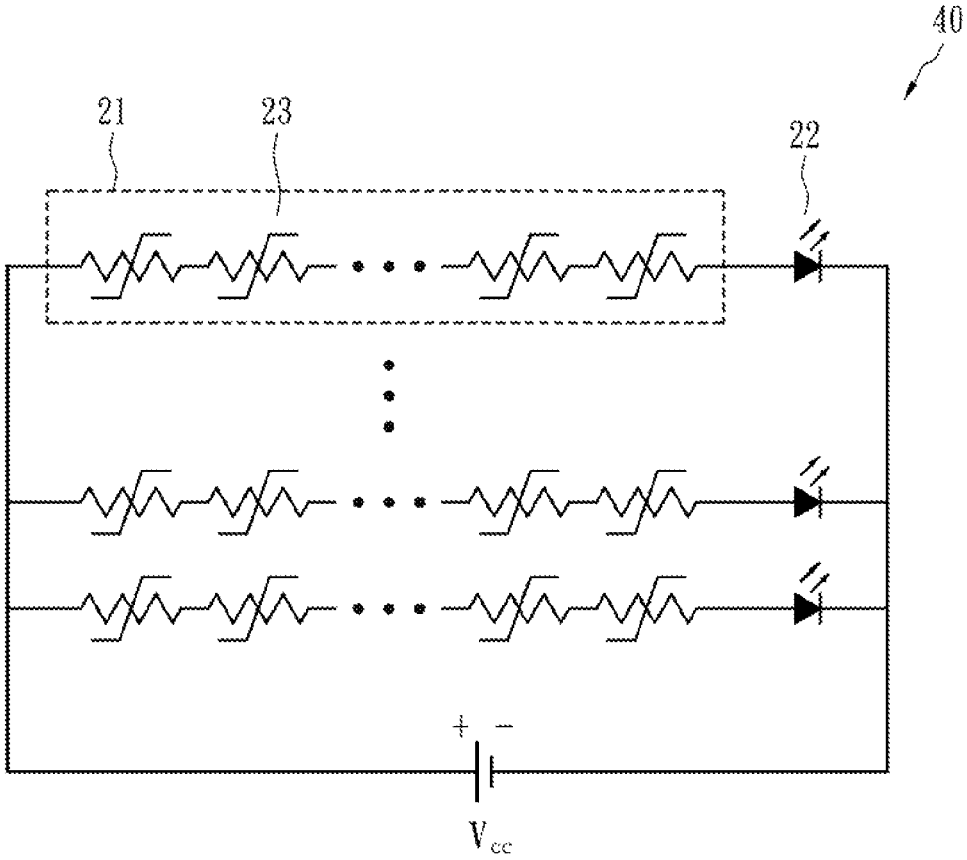
FIG. 4 shows an LED apparatus in accordance with a third embodiment of the present application.

For illumination, a plurality of LEDs 22 may be used, so as to form a stripe or an array light source, as illustrated by FIGS. 3 and 4 below.

FIG. 3 shows an LED apparatus 30 in accordance with a second embodiment of the present application, in which an LED component 25 includes a plurality of LEDs 22 connected in series. The LED apparatus 30 includes the LED component 25 and a current-limiting device 21. The LED component 25 and the current-limiting device 21 are connected in series and are coupled to a power supply voltage $V_{cc}$. The current-limiting device 21 includes a plurality of PTC devices 23. Assuming there are n LEDs, the current-limiting resistance value is:

$$\text{Current-limiting resistance} = \frac{\text{Power supply voltage } V_{cc} - n \times \text{forward voltage } V_f}{\text{Operating current}}$$

Like the calculation in the first embodiment, the number of the PTC devices can be accordingly chosen to form the current-limiting device. The resistance value of the current-limiting device increases with increasing temperature, and is close to or equal to the current-limiting resistance value at an LED normal operating temperature. When the LED gradually heats up to an abnormal temperature, the current allowable to be flowed through the current-limiting device decreases to be lower than the LED operating current.

FIG. 4 shows an LED apparatus 40 in accordance with a third embodiment of the present application. The LED apparatus 40 includes current-limiting devices 21 and LEDs 22, the LEDs 22 being connected in parallel and coupled to a power supply voltage $V_{cc}$. Each current-limiting device 21 includes a plurality of PTC devices 23 connected in series, and each current-limiting device 21 is connected to an LED 22. This embodiment is like to connect a plurality of assemblies each containing serially connected current-limiting device 21 and LED 22 shown in FIG. 2 in parallel, thereby providing multi-LED applications. Likewise, a plurality of assemblies each containing serially connected current-limiting device 21 and LED component 25 shown in FIG. 3 can be connected in parallel for various applications.

In view of the above, the present application has the following features and advantages to resolve LED over-heat problem: (1) Current limitation occurs before PTC devices heat up to trip temperature, thereby increasing lifetime of PTC devices and diminishing obvious change of LED brightness. (2) The PTC devices are connected in series to magnify the resistance; therefore temperature change can be readily sensed according to voltage drop by applying relatively small current. This feature can be used for monitoring low temperature environment or verifying small temperature variances. (3) The PTC devices become more sensitive to temperature variation, and may be directly placed on the circuit or form a single current-limiting device by printed circuit technology, by which the current-limitation performs directly and rapidly. Compared to IC current-limiting manner, the current-limiting device using PTC devices is more simple and cost-effective. (4) In addition to current-limitation, the current-limiting device of the present application still has over-current protection function. In other words, the present application provides a multi-functional device of current-limiting, over-current protection, over-temperature protection, temperature regulating, and monitoring functions. (5) According to the prior arts, the PTC device does not provide protection only if the PTC is tripped when LED over-heats. However, the current-limiting device of the present application can automatically regulate LED temperature before the LED heats up to its allowable highest temperature.

The above-described embodiments of the present invention are intended to be illustrative only. Numerous alternative embodiments may be devised by persons skilled in the art without departing from the scope of the following claims.

We claim:

1. An LED apparatus; comprising:

an LED component corresponding to a current-limiting resistance value and comprising at least one LED of a forward voltage and an operating current; and a current-limiting device comprising a plurality of positive temperature coefficient devices merely connected in series, the positive temperature coefficient devices being capable of sensing temperature of the LED and electrically coupled to the LED component;

wherein a resistance value of the current-limiting device increases with increasing sensed temperature, the resistance value of the current-limiting device at an LED normal operating temperature is close to or equal to the current-limiting resistance value; when the temperature of the LED gradually increases to an abnormal temperature, current allowable to be flowed through the current-limiting device gradually decreases to be lower than the operating current, wherein the plurality of positive temperature coefficient devices have yet to reach a trip temperature thereof when the at least one LED increases to the abnormal temperature.

2. The LED apparatus of claim 1, wherein the LED component is coupled to a power supply voltage, and the LED component comprises n LEDs and where n is a positive integer, if n is greater than or equal to 2 and the n LEDs are connected in series, the current-limiting resistance value is obtained by the following equation:

$$\text{Current limiting resistance} = \frac{\text{Power supply voltage} - n \times \text{Forward voltage}}{\text{Operating current}}.$$

3. The LED apparatus of claim 1, wherein the current allowable to be flowed through the positive temperature coefficient device at the LED normal operating temperature is close to or equal to the operating current.

4. The LED apparatus of claim 1, wherein the trip temperature is greater than or equal to 70° C.

5. The LED apparatus of claim 1, wherein the trip temperature is greater than the abnormal temperature by between 10° C.-35° C.

6. The LED apparatus of claim 1, wherein the abnormal temperature is greater than or equal to 60° C.

7. The LED apparatus of claim 1, wherein the current-limiting device at the LED normal operating temperature has a resistance less than the current-limiting resistance value.

8. The LED apparatus of claim 1, wherein the current-limiting device at the LED normal operating temperature has a resistance different from the current-limiting resistance value by less than 30%.

9. The LED apparatus of claim 1, wherein the current-limiting device is distanced from the LED component by less than 5 centimeters.

10. A current-limiting device which is applied to an LED component of a current-limiting resistance value, the LED component comprising at least one LED of a forward voltage and an operating current, the current-limiting device comprising:

a plurality of positive temperature coefficient devices merely connected in series and coupled to the LED component and being configured to sense a temperature of the LED;

wherein the current-limiting device increases its resistance value as the sensed temperature rises, and the resistance value of the current-limiting device at an LED normal operating temperature is close to or equal to the current-limiting resistance value; when the temperature of the LED gradually increases to an abnormal temperature, current allowable to be flowed through the current-limiting device gradually decreases to be lower than the operating current, wherein the plurality of positive temperature coefficient devices have yet to reach a trip temperature thereof when the at least one LED increases to the abnormal temperature.

11. The current-limiting device of claim 10, wherein the LED component is coupled to a power supply voltage and the LED component comprises n LEDs, where n is a positive integer and if n is greater than or equal to 2 and the n LEDs are connected in series, the current-limiting resistance value is obtained by the following equation:

$$\text{Current limiting resistance} = \frac{\text{Power supply voltage} - n \times \text{Forward voltage}}{\text{Operating current}}.$$

12. The current-limiting device of claim 10, wherein current allowable to be flowed through the positive temperature coefficient device at the LED normal operating temperature is close to or equal to the operating current.

13. The current-limiting device of claim 10, wherein the trip temperature is greater than or equal to 70° C.

14. The current-limiting device of claim 10, wherein the abnormal temperature is greater than or equal to 60° C.

15. The current-limiting device of claim 10, wherein the current-limiting device at the LED normal operating temperature has a resistance different from the current-limiting resistance value by less than 30%.

16. The current-limiting device of claim 10, wherein the current-limiting device is a single device formed of a conductive material and formed into a circuit.

* * * * *